United States Patent [19]

Appel et al.

[11] Patent Number: 4,687,317

[45] Date of Patent: Aug. 18, 1987

[54] DOCUMENT SCANNING SYSTEM WITH SELECTIVE EDIT MODE

[75] Inventors: James J. Appel, Ontario; Daniel W. Costanza, Webster; Richard M. Dastin, Fairport, all of N.Y.

[73] Assignee: Xerox Corporation, Stamford, Conn.

[21] Appl. No.: 873,579

[22] Filed: Jun. 12, 1986

[51] Int. Cl.[4] ..... G03G 15/00

[52] U.S. Cl. ..... 355/3 R; 355/7; 355/8

[58] Field of Search ..... 355/3 R, 7, 8; 14 R, 355/14 E; 358/293

[56] References Cited

U.S. PATENT DOCUMENTS

| | | | |
|---|---|---|---|
| 4,281,904 | 8/1981 | Sprague et al. | 350/356 |
| 4,374,617 | 2/1983 | Fisli | 355/8 |
| 4,378,156 | 3/1983 | Yajima et al. | 355/77 |
| 4,386,827 | 6/1983 | Scifres et al. | 350/356 |
| 4,471,386 | 9/1984 | Tukro | 358/280 |
| 4,616,269 | 10/1986 | Mori | 355/7 X |
| 4,634,260 | 1/1987 | Watanabe | 355/7 |

FOREIGN PATENT DOCUMENTS

| | | | |
|---|---|---|---|
| 56-85767 | 7/1981 | Japan | 355/7 |
| 56-83170 | 7/1981 | Japan . | |

*Primary Examiner*—Arthur T. Grimley
*Assistant Examiner*—J. Pendegrass

[57] ABSTRACT

A light lens scanning system operable in a document scan mode to reproduce documents onto a photosensitive record medium is modified to operate in a document edit mode. Upon selection of an edit mode, a document is placed face-up on a platen surface by the operator. A laser generated light spot output is introduced into the optical system and is directed along an optical path which is opposite to the optical path of a projected document image. The light spot output is visible to the operator at the platen as a light cursor. This movement of the cursor is placed under control of the operator. The cursor is moved through x and y coordinates to delineate an area of the document to be selectively erased. Coordinate positions are entered into a microcontroller memory. Following exposure of the entire image at the record medium, control means generate signals in response to entered coordinate positions, the signals used to actuate an erase mechanism for a time sufficient to erase the selected portion of the document.

5 Claims, 8 Drawing Figures

9
F
E
86
88
20
D
84
50
52
8
22
26
34
24
18
80
40
42
46
A
12
83
81
P1
63
V2
V1
10
B
48
40
44
54
62
B
V5
30
32
56
64
62
C
C
V4
V3
P2
46
82
58a
72
74
60
58
58b
36
16
70
6

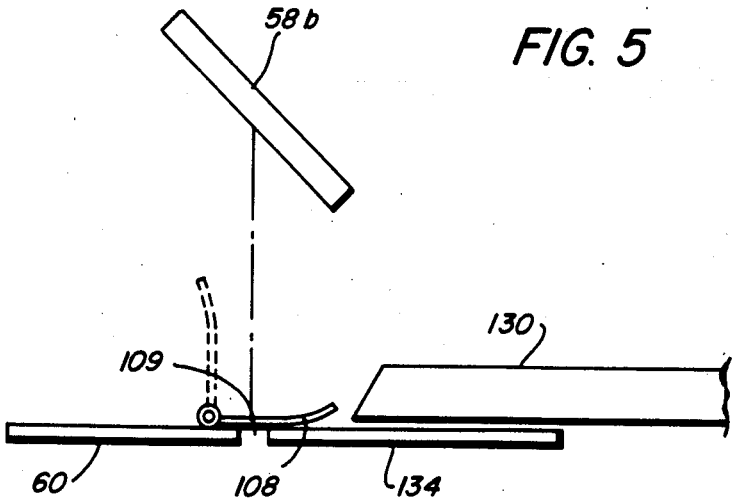
FIG. 5
FIG. 7
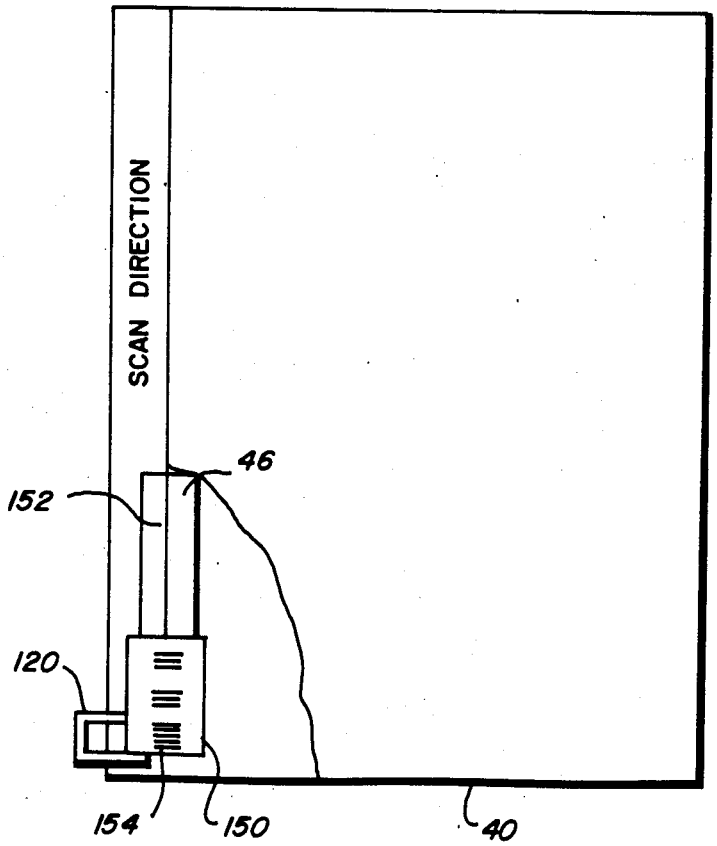

DOCUMENT SCANNING SYSTEM WITH SELECTIVE EDIT MODE

The present invention relates to an electrophotographic reproduction system and, more particularly, to an optical scanning system which, in a first scan mode of operation, scans a document to expose an image at a photosensitive image plane and, in a second, edit mode of operation, selectively edits a document prior to the scan mode to create a selective document reproduction at the image plane.

When an original document is being reproduced, it is often desirable to avoid copying certain portions of the document original. For example, a user may wish to suppress paste-up lines, erase black borders when copying book pages, delete sensitive portions of a letter or erase areas for 2-pass color highlighting. This editing of the final form of the output copy, referred to in the art as composing, has heretofore been accomplished by several methods, each of which have attendant disadvantages. One prior art method involves cutting and affixing blank white sheets over the image areas of the document to be erased. This procedure is cumbersome and often results in a poor quality copy having image patterns of varying intensity. A second method, as disclosed in U.S. Pat. No. 4,471,386, requires the application of a retro-reflective material to portions of a document to be deleted; scanning the document and incrementally forming an image at a linear photodetector array. This method also has the disadvantage of requiring application of a material to those areas to be erased, increasing the reproduction time.

It would be desirable to selectively edit an original document without the necessity for affixing reflective material to the original document. It would also be desirable to add an editing capability to a document optical scanning system with a minimum of additional components. The present invention is directed to a light lens scanning system which reproduces a document during a normal (non-editing) scan reproduction mode but which is adapted to operate in an editing mode by directing a laser-generated scanning beam along an optical path in a direction reverse to the light ray progression during the normal scan mode. The laser output appears as a cursor light beam on the underside of the platen and is of sufficient intensity to be viewable through the normal thickness of a document. The position of the beam is operator-controllable in a first direction transverse to the normal mode scan path by selectively adjusting the portion of the beam which is illuminated. The position of the cursor in the scan direction is controlled by movement of the carriage which seats a scan illumination assembly. An operator, in an edit mode, can therefore highlight selected portions of a document and enter the coordinates into a control memory. The highlighted segments of the document are later erased following the exposure process. More particularly, the invention relates to a document reproduction machine wherein a document on a transparent platen support is reproduced as a latent image on a photosensitive record medium, a first optical system for scan/illuminating the document and for projecting an image thereof along an optical path onto said record medium.

a second optical system enabled in a document edit mode, said second system including a raster output scan assembly adapted to generate a light spot output, and further including means for modifying said light spot output and for directing said output along said first optical system optical path in a direction reverse to said projected image path, said light output forming a light cursor at the surface of said platen, said cursor visible to an operator through a document placed thereon, and operator actuable means for moving said cursor spot along two coordinate directions to define areas of the document to be edited.

FIG. 5 is an enlarged view of a shutter mechanism shown in FIG. 1.

FIG. 7 shows a top view of the platen, showing a coded credit card being scanned by the cursor.

Figure 1:
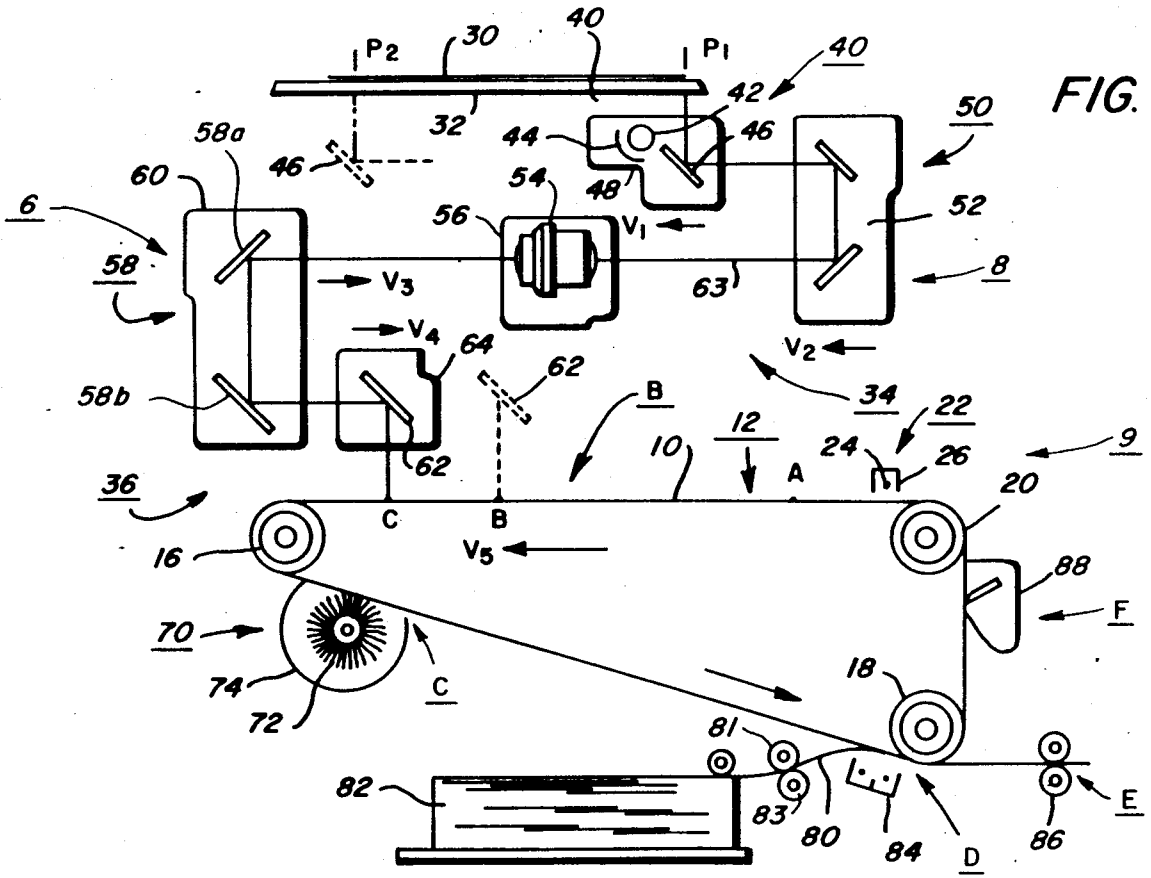
FIG. 1 is a side schematic view of an electrophotographic reproduction machine incorporating the scanning and editing system of the present invention.

Referring now to FIG. 1, an exemplary scanning system 8, embodying the principles of the present invention is shown. It will become apparent from the following discussion that this editing device is equally well suited for use in q wide variety of scanning systems and is not necessarily limited in its application to the particular embodiment shown herein. System 8 is adapted to operate in either a conventional document scanning mode wherein a document is incrementally scanned and a latent image is formed on a photoreceptor surface, or in a document editing mode wherein a beam of light is used to delineate, or highlight, areas of a document to be selectively erased. The conventional scanning portion of FIG. 1 is described first followed by a description of the optical components which enable the selective edit mode.

Scanning system 8 is part of an electrophotographic reproduction machine 9 using a photoreceptor belt 10 which moves in the indicated direction, advancing sequentially through various xerographic process stations. The belt is entrained about drive roller 16 and tension rollers 18, 20. Roller 16 is driven by motor means described in detail below. A portion of belt 10 passes through a charging station where a corona generating device, indicated generally by the reference numeral 22, charges photoconductive surface 12 of belt 10 to a relatively high, substantially uniform, negative potential. Device 22 comprises a charging electrode 24 and a conductive shield 26.

As belt 10 continues to advance, the charged portion of surface 12 moves into exposure station B. In the normal scan mode, an original document 30 is positioned, either manually, or by a document feeder mechanism (not shown) on the surface of a transparent platen 32. Optics assembly 36 contains the optical components which incrementally scan-illuminate the document from left to right and project a reflected image onto surface 12 of belt 10. Shown schematically, these optical components comprise an illumination scan assembly 40, comprising illumination lamp 42, associated reflector 44 and full rate scan mirror 46, all three components mounted on a scan carriage 48. The carriage ends are adapted to ride along guide rails (not shown) so as to travel along a path parallel to and beneath, the platen. Lamp 42 illuminates an incremental line portion of document 30 extending the width of belt 10. The reflected image is reflected by scan mirror 46 to corner mirror assembly 50 mounted on a second scan carriage 52. Scan carriage 52 is mechanically connected to carriage 48 and adapted to move at ½ the rate of carriage 48. The incremental document images are projected through lens 54, mounted on lens carriage 56 and reflected by a second corner mirror assembly 58, mounted on carriage 60 and by belt mirror 62, mounted on carriage 64. Assembly 58 comprises mirrors 58*a* and 58*b*. Carriages 60 and 64 are moving at a predetermined relationship so as to precess the projected image, while maintaining the required rear conjugate, onto surface 12 to form thereon a center-registered electrostatic latent image corresponding to the informational areas contained within original document 30. As is understood by those skilled in the art, scanning system components and scan speeds could be changed such that scanning is accomplished in a non-precession mode. At development station C, a magnetic brush development system, indicated generally by the reference numeral 70, advances an insulating development material into contact with the electrostatic latent image. Preferably, magnetic brush development system 70 includes a developer roller 72 within a housing 74. Roller 72 transports a brush of developer material comprising a magnetic carrier granules and toner particles into contact with surface 12 of belt 10. Roller 72 is positioned so that the brush of developer material deforms belt 10 in an arc with the belt conforming, at least partially, to the configuration of the developer material. The thickness of the layer of developer material adhering to developer roller 72 is adjustable. The electrostatic latent image attracts the toner particles from the carrier granules, forming a toner powder image on photoconductive surface 12.

Continuing with the system description, an output copy sheet 80 taken from a supply tray 82 is moved into contact with the toner powder image at transfer station D. The support material is conveyed to station D by a pair of feed rollers 81, 83. Transfer station D includes a corona generating device 84 which sprays ions onto the backside of sheet 80, thereby attracting the toner powder image from surface 12 to sheet 80. After transfer, the sheet advances to fusing station E where a fusing roller assembly 86 affixes th transferred powder image. After fusing, sheet 80 advances to an output tray (not shown) for subsequent removal by the operator.

After the sheet of support material is separated from belt 10, the residual toner particles and the toner particles of developed test patch areas are removed at cleaning station F by blade cleaner assembly 88.

Subsequent to cleaning, a discharge lamp, not shown, floods surface 12 with light to dissipate any residual charge remaining thereon prior to the charging thereof for the next imaging cycle.

Figure 2:
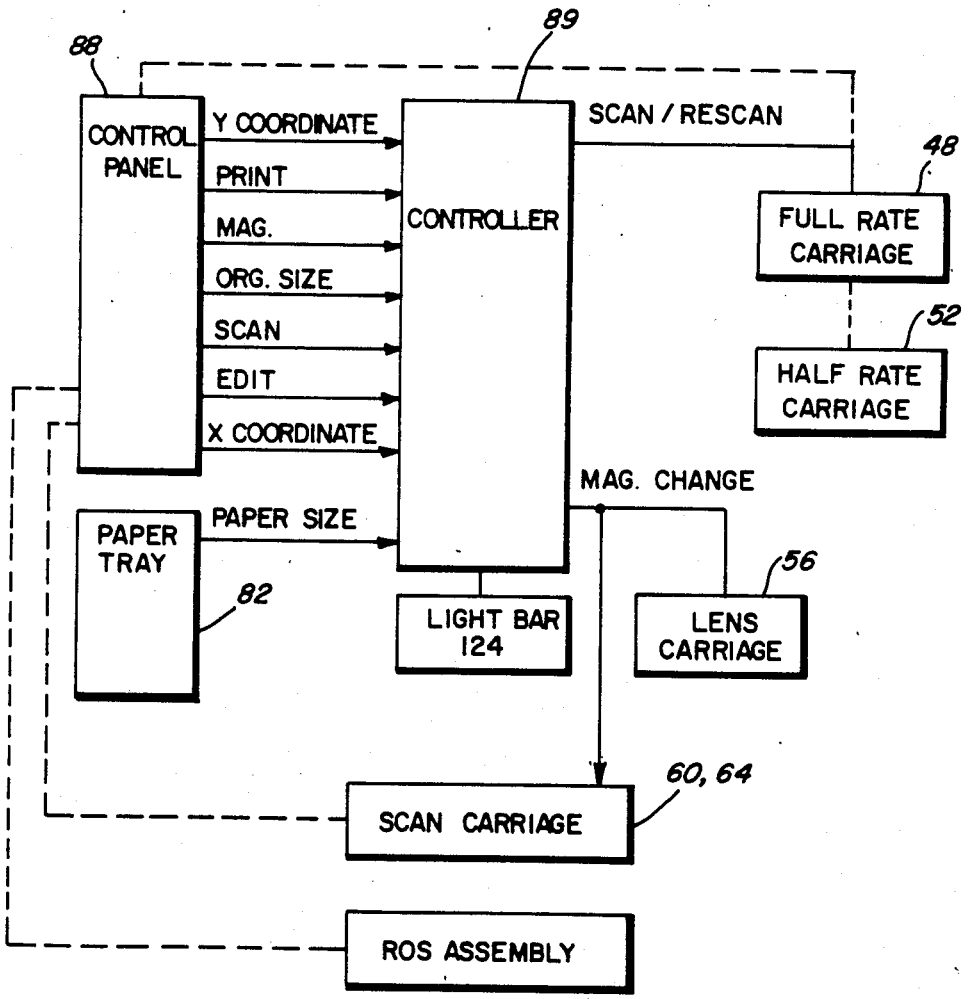
FIG. 2 is a functional block diagram of the control circuits to implement the edit mode of operation.

The operation of the various components that comprise machine 9 in a predetermined, timed relationship are controlled by a controller 89 which incorporates a suitable microprocessor and memory. As shown in FIG. 2, operator selection at control panel 88 of print, magnification selection and document size information are sent to controller 89 which generates the signals to operate the main belt drive motor, the optical component carriages and the lens carriage.

The foregoing description of a precession scanning system and the control circuitry are more fully described in co-pending U.S. application Ser. Nos. 748,072 filed 6/24/85 and 798,369, filed 11/18/85, whose contents are hereby incorporated by reference.

Figure 3:
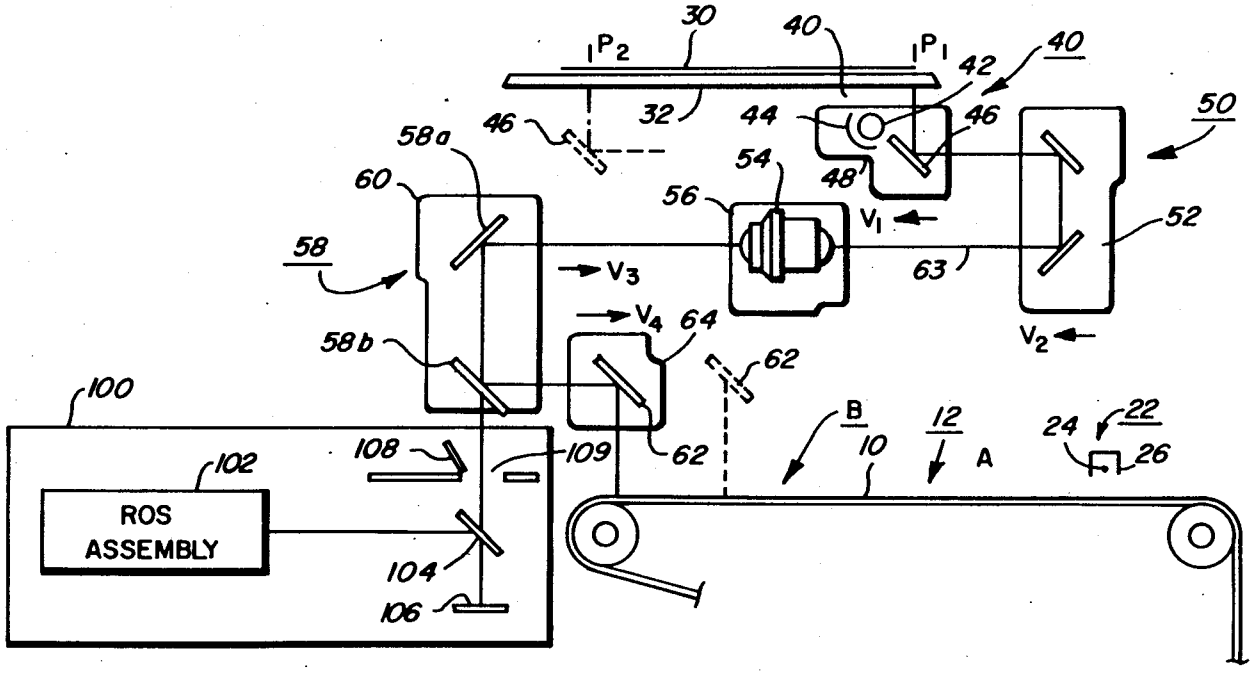
FIG. 3 is a schematic side view of a portion of the scanning system of FIG. 1.

Turning now to a consideration of the selective edit mode, FIG. 3 shows the scanning system 36 of FIG. 1 modified to include several additional optical elements which are contained in a housing 100. Housing 100 contains a raster output scanner (ROS) assembly 102, a partially silvered mirror 104, a fresnel reflector 106 and a shutter 108. The edit mode is enabled by an operator making an appropriate selection at control panel 88. The control panel generates an output signal sent to controller 89 which effectively places control of ROS assembly 102 and scan carriage 48 with the operator for purposes described in further detail below. Operator control is indicated in FIG. 2 by dotted outputs to these components.

Figure 4:
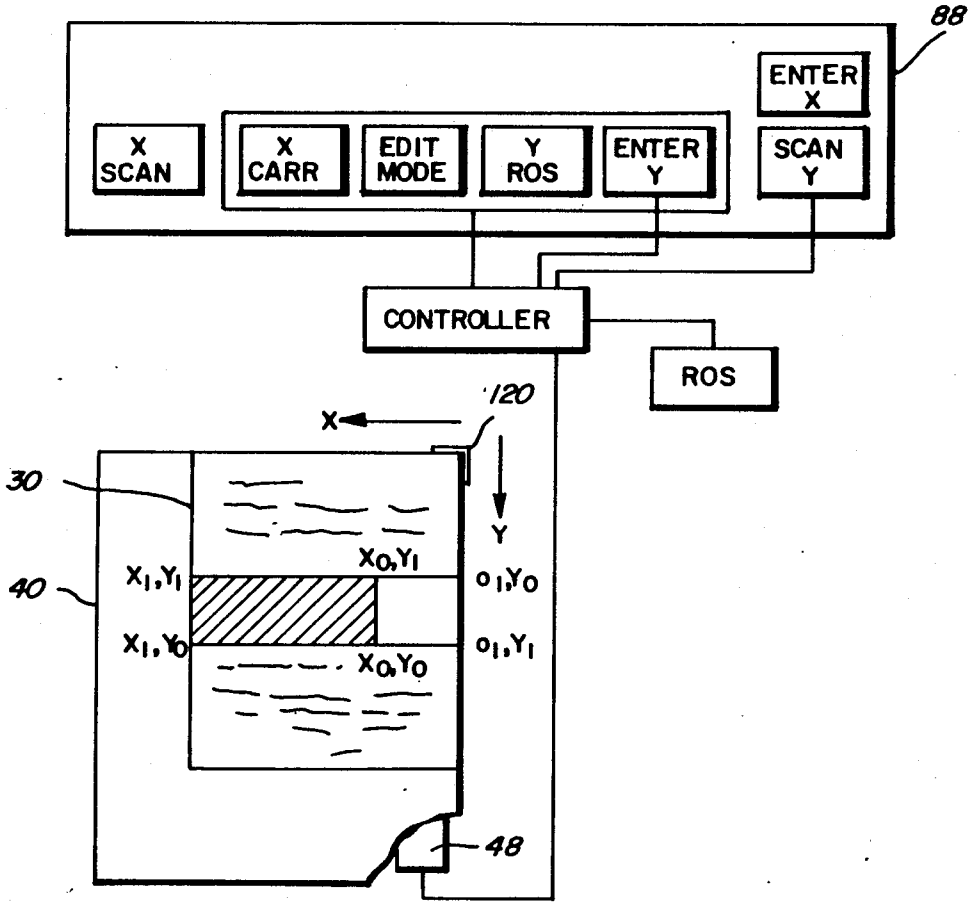
FIG. 4 is a top view of the platen and operator control panel showing the regular document registered in an edit mode.

In order to enable the edit mode, the operator places an original document 30 face up on platen 40 registered against corner 120 as shown in FIG. 4. Platen 40, in the preferred embodiment, is an 17 inch by 17 inch glass substrate. For purposes of illustration, it is assumed that the operator wishes to reproduce the entire content of document 30 except for a segment of information 122 bounded by the coordinates $X_0$ and $X_1$ and the y coordinates $y_0$ and $y_1$. This segment 122 may, for example, contain confidential information which the operator wishes to delete from the output copy. The operator depresses the "EDIT MODE" control on control panel 88, generating an output signal to controller 89. This action has the effect of placing the operation of scan carriage 48 and ROS assembly 102 under operator control via switches "X CARR" and "Y ROS", respectively. Signals are also generated by controller 89, driving lens carriage 56 towards a position associated with a 0.86X reduction and drive carriage 60 to its home positions. This permits the operator to define the document area to be erased by setting coordinate positions for a visible cursor input produced in the following manner. Assembly 102, in a preferred embodiment, includes an electro-optical modulator 103 of the type disclosed in U.S. Pat. Nos. 4,281,904 and 4,386,827. The modulator is capable of producing an output of one or more light spots, the total number defining a scan line at the platen surface in the y direction. The output of assembly 102 is first reflected downward from partially silvered mirror 104 (FIG. 3). The back surface of mirror 104 is coated with an anti-reflection material; the mirror reflectivity is approximately 15% in a preferred embodiment. The beam is reflected upward by fresnel reflector 106, chosen for field lens properties to provide for proper focusing of the beam as it enters the aperture of lens 54. The beam, after being reflected from fresnel reflector 106, again passes through mirror 104, through shutter aperture 109, and through mirror 58*b* which, in the preferred embodiment, has a transmission at the laser wavelength of 12%. The light ray then propagates in the reverse direction of the normal scan path, passing through lens 54, being reflected from mirror assembly 50 and mirror 46 to incidence on the bottom surface of platen 40. The cursor beam is visible to the operator as a spot of light penetrating through the thickness of document 30. The intensity of the spot has been reduced by the transmission properties of mirror 58*b* and is thus rendered non-hazardous to the operator.

At this point, the operator views a cursor spot lying along the left edge of platen 30 (FIG. 4). The spot can be moved in the y direction by depressing the "Y ROS" control until the spot is centered over either the $0_1$, $y_0$ or 0, $y_1$ coordinate position. A scan line of length $y_0$, $y_1$ can then be formed by depressing the "Y SCAN" control until the cursor line lengthens to the required coordinates. The optical path of the laser scan is configured to span the photoreceptor width (typically 14.33") or to expand to cover the entire 17 inch width of the platen. At this point the operator depresses the "ENTER Y" switch which causes the y coordinate position to be entered into memory circuits contained within controller 89. The operator then depresses the "X CARRIAGE" switch causing the carriage 48 to begin incrementally moving in the x(scan) direction. When the cursor beam scan line reflected from the surface of mirror 46 reaches the $x_0,y_0-x_0,y_1$ location, the operator depresses the "ENTER X" switch causing the 1st x coordinate position recorded on servo encoders associated with carriage 48, to be entered into the controller memory. The operator then depresses the "X CARRIAGE" switch again moving the carriage along the scan direction until the cursor line reaches the $x_1,y_0-x_1,y_1$ location. This second coordinate is entered into the computer memory in the same manner as the $X_0$ coordinate.

At this point, the area corresponding to 122 has been designated for deletion in a manner to be described below. The scan system is now returned to the normal scan mode by depressing the "SCAN" switch. Carriage 48 is automatically returned to the start of scan position and lens 54 returns to the normal 1X position shown in FIG. 1. The document is then placed in the face-down position in the normal copying, registered against corner 120. The document is then scanned in a normal scan mode of operation and a latent image of the entire document is formed at surface 12 of belt 10.

The latent image on the belt surface moves out of the exposure zone and passes opposite the ROS 102 unit in FIG. 3. In a preferred embodiment, the ROS assembly is used to selectively erase the edited area. As the document latent image moves through optical path 121, mirror 104 is pivoted out of the optical path and modulated erase signals from ROS 102 assembly are directed to the photoreceptor surface. The signals are maintained until the erase area length (conforming to the x coordinates entered into memory) are reached, at which time the erase signal is terminated. The resulting "edited" latent image thus provides output copy of the original document with the area 122 blocked out (undeveloped).

The above description ignored, for the sake of continuity, the function of shutter 108 shown in FIG. 5. The shutter is mounted on carriage 60 and performs the function of blocking light from passing through mirror **58*b*. Since the transmission of mirror 58*b* has been defined as 12% of the laser wavelength, this mirror will also transmit visible light of other wavelengths. During a document scan cycle, some of this light passing through the six mirror optical system will be transmitted through mirror 58*b*, resulting in undesirable erasure of the underlying latent image being formed on the photoreceptor surface. FIG. 5 shows an enlarged view of the mounting arrangement of the shutter. As shown, shutter 108 is pivotably mounted to the top surface of carriage 60, underlying mirror 58*b*. The shutter, having a width conforming to the width of mirror 58*b*, is in the closed position (solid line) at all times during the scan cycle, except when carriage 60 is in the home position. Thus, the shutter will block light passing through mirror 58*b* during the scan and rescan cycle. When the carriage is moved to the home position (which occurs during copy mode and also upon initiation of the edit mode) the shutter is pivoted upward to the open position by contacting a projection 130 which forms part of the machine housing adjacent the carriage 60 home position. When the shutter is in the open position, the laser beam, which is very narrow at the shutter location can pass through the aperture 109 and proceed in the reverse direction through the optical system. To ensure complete blockage of light, a baffle 134 can be mounted to the bottom of projection 130**.

Figure 6:
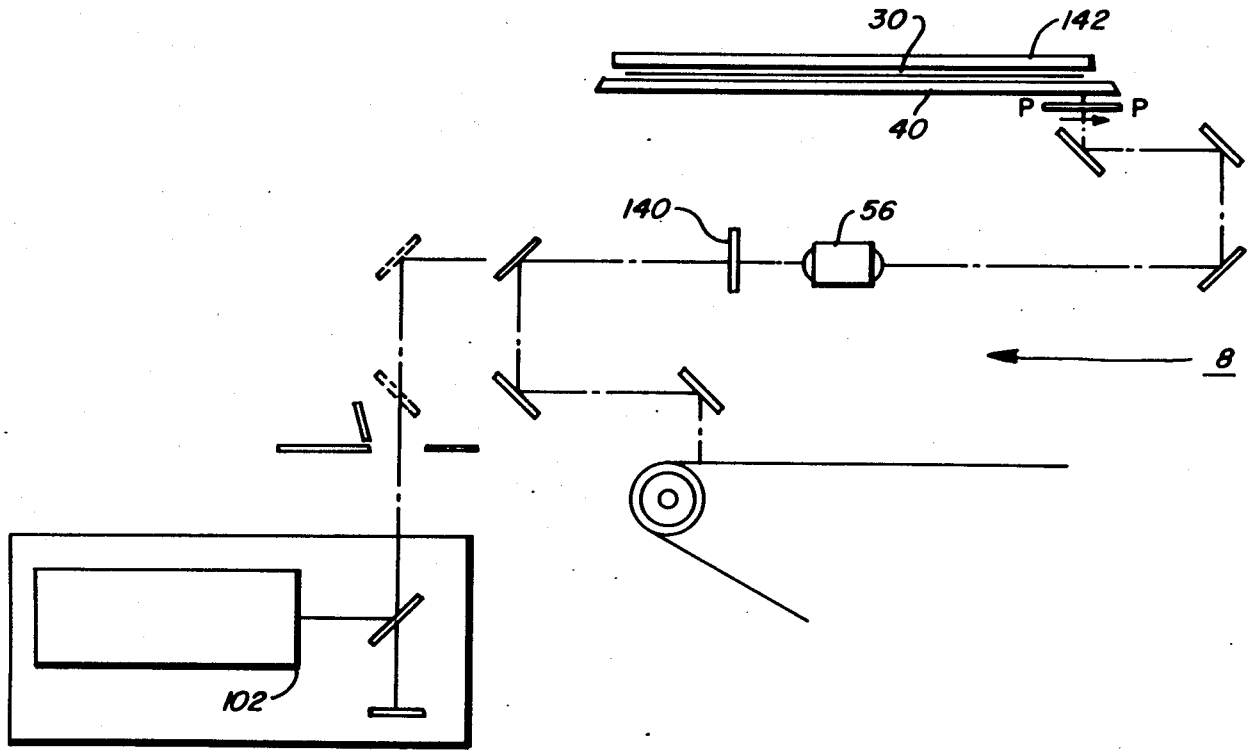
FIG. 6 shows the scanning system of FIG. 3 with additional polarizing components.

Depending upon the laser generator employed for the particular system, laser safety requirements may dictate the need for additional operator protection. FIG. 6 shows a modified scan system 8 which includes polarizing optical elements to prevent any direct laser light from the cursor from reaching the operator's eyes. Referring to FIG. 6, a polarizing filter 140 is positioned near the aperture of lens 54. The effect of this filter is to polarize the cursor light in the plane of the original document, parallel to the page as shown by arrow P-P. The polarized light then passes through platen 40 and is incident on document 30. The light is transmitted diffusely through the original document and becomes unpolarized due to this diffuse transmission. A cover 142, made from a sheet of polarizing material is placed over document 30. Cover 142 has its direction of polarization in the plane of the document, but perpendicular to the polarization of the cursor light. The direction of polarization is into the page. The light becomes unpolarized after passing through the original document and is now visible to the operator, at a safe illumination level, through the polarizing cover.

This polarizing arrangement protects an operator in situations where there is no document on the platen or the cursor is moved to a position off the edge of the document being edited and the edit function is enabled. As long as cover 142 is in place, the polarized light will be completely extinguished by the cross-polarized cover. An interlock arrangement can be built into the machine to prevent the edit mode from being enabled if cover 142 is not in its operative position.

According to a further aspect of the present invention, scan system 8 can be modified so as to operate in a scan/read mode wherein an original coded object placed face down on the platen is scanned by the cursor beam and information recorded therein is captured electronically and subsequently used for purposes described below.

Figure 8:
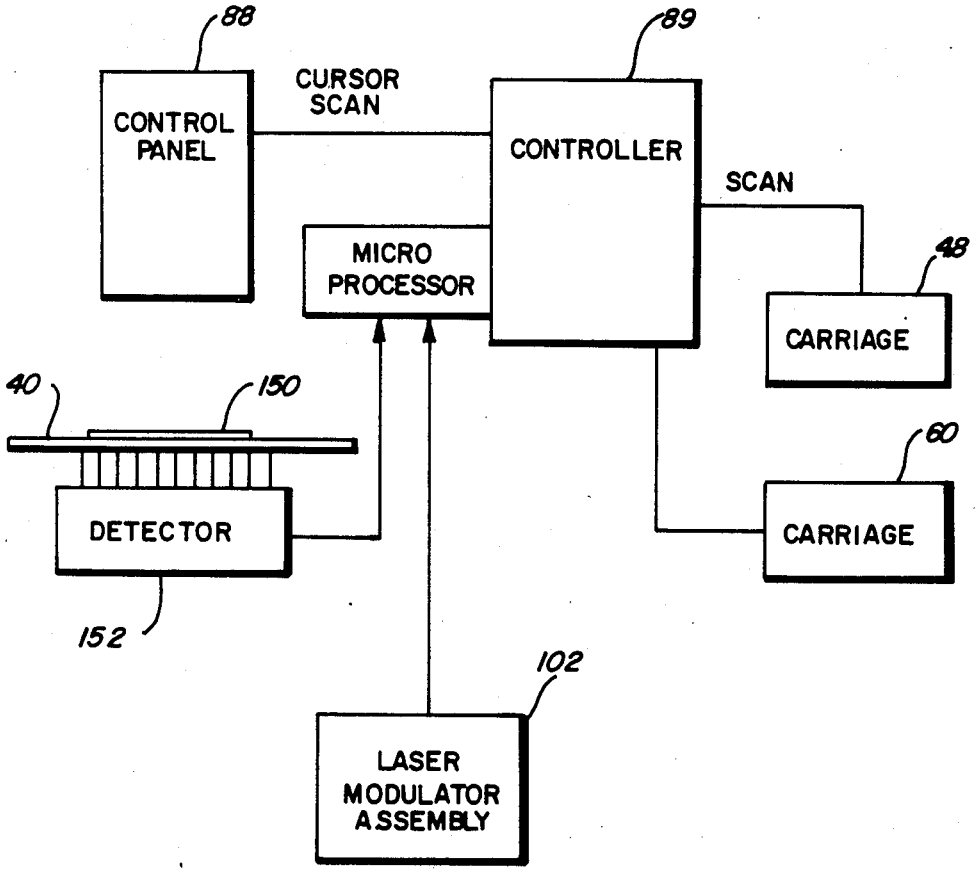
FIG. 8 is a functional block diagram of a control circuit for the credit card scan function.

As a first example, FIG. 7 shows a view of the top of platen 40 with a credit card 150 registered against corner 120. (Card 150 could, for example, be a user card which would provide information for billing purposes.) A linear light detector 152 is attached to the top of mirror 46 in close proximity to the bottom surface of the platen. In operation, an operator (customer) would place card 150 with a bar code 154 formed on one side, face-downward in the registration position shown. The platen cover 142 (FIG. 6) would be closed. The operator would then press a "CURSOR SCAN" switch at control panel 88 (FIG. 8). Controller 89 generates an output signal to carriage 48 to move mirror 46 (and detector 152) into position beneath code 154. Additional output signals from controller 89 to modulator assembly 102 enables a sequential scan mode whereby the cursor spot would incrementally scan the code in the indicated direction. Detector 152, which in a preferred embodiment is a linear photodiode, detects the light reflected from the bar code and produces output signals representative of the detected light levels (which would vary with time according to placement of the bar). Thus, the detector output signal would be high when a white background portion of the card is illuminated and low when a black bar is illuminated.

According to a still further aspect of the present invention, instead of reading a credit card bar code, an encoded document may be registered on the platen and scanned in a similar fashion. The documentation have encoded information relating to, for example, set-up information for a copying run which it is desired to repeat at a later time. The encoded portion of the document would represent information such as magnification, copy darkness, selective erasure, coordination, simplex/duplex run length, page size, etc. The encoded portions are scanned by the cursor, as described above, carriage 46 moving to position detector 152 for each area scan line. Following completion of the scan encoded document, the controller 89 generates an output signal to modulator assembly 102, causing the modulator to form a latent image pattern containing the scanned encoded information. The image pattern can be developed and transferred to a second medium which, in turn, becomes the encoded document for a copy run at a later date.

While the invention has been described with reference to the structure disclosed, it is not confined to the details set forth, but is intended to cover such modifications or changes as may come within the scope of the following claims:

What is claimed:

1. In a document reproduction machine wherein a document on a transparent platen support is reproduced as a latent image on a photosensitive record medium, a first optical system for scan/illuminating the document and for projecting an image thereof along an optical path onto said record medium, a second optical system enabled in a document edit mode, said second system including a raster output scan assembly adapted to generate a light spot output, and further including means for modifying said light spot output and for directing said output along said first optical system optical path in a direction reverse to said projected image path, said light output forming a light cursor at the surface of said platen, said cursor visible to an operator through a document placed thereon, and operator actuable means for moving said cursor spot along two coordinate directions to define areas of the document to be edited.

2. The machine of claim 1 further including controller means for enabling said scan and edit modes of operation, said means containing memory means for storing coordinates of said defined document areas.

3. The machine of claim 2 further including charge erase means controlled by said controller means for erasing portions of the document latent image defined by said coordinates.

4. The optical system of claim 1 wherein said second optical system includes polarizing optical elements which polarize the cursor light in the plane of the document.

5. The machine of claim 1 wherein said document has coded information formed on one surface, said second optical system further including a photodetector placed beneath the platen and adapted to receive light reflected, during a scan mode, from said coded portions and to produce an output signal representative of said coded information.

* * * * *